US009392827B2

(12) United States Patent
Farney

(10) Patent No.: US 9,392,827 B2
(45) Date of Patent: Jul. 19, 2016

(54) HEADBAND APPARATUS FOR WICKING AND DIRECTING PERSPIRATION

(76) Inventor: Michael Kent Farney, Broken Arrow, OK (US)

( * ) Notice: Subject to any disclaimer, the term of this patent is extended or adjusted under 35 U.S.C. 154(b) by 248 days.

(21) Appl. No.: 12/238,280

(22) Filed: Sep. 25, 2008

(65) Prior Publication Data

US 2009/0077716 A1 Mar. 26, 2009

Related U.S. Application Data

(60) Provisional application No. 60/975,113, filed on Sep. 25, 2007.

(51) Int. Cl.
*A41D 20/00* (2006.01)
*A42C 5/02* (2006.01)

(52) U.S. Cl.
CPC .. *A41D 20/00* (2013.01); *A42C 5/02* (2013.01)

(58) Field of Classification Search
USPC ..... 2/414, 416, 417, 418, 422, 424, 425, 9, 2/171, 181–184, 181.2, 181.4, 181.6, 2/181.8, 182.1, 182.2, 182.3, 182.4, 2/182.5, 182.6, 182.7, 182.8, 174, 171.2, 2/171.4, 209.13, 209.14, 901, DIG. 11; D2/865, 866, 894; 604/19, 312
See application file for complete search history.

(56) References Cited

U.S. PATENT DOCUMENTS 2,320,782 A * 6/1943 Larsen ..... 2/171
4,626,247 A * 12/1986 Frankel ..... 604/312
4,638,512 A 1/1987 Frankel
4,815,144 A * 3/1989 Martin ..... 2/7
5,146,630 A * 9/1992 Richard ..... 2/181
5,640,721 A * 6/1997 Jackson ..... 2/171
5,740,556 A * 4/1998 Brown ..... 2/181
5,781,932 A * 7/1998 Brown ..... 2/181
5,926,849 A * 7/1999 Boyle ..... 2/181.8
6,026,518 A * 2/2000 Brown ..... 2/439
6,353,936 B2 3/2002 Flatt
6,502,245 B1 * 1/2003 McBride ..... 2/181
6,567,991 B1 * 5/2003 Holslag et al. ..... 2/181.4
6,584,984 B2 * 7/2003 Kelly ..... 132/212
7,093,303 B2 * 8/2006 Thorson ..... 2/13
7,398,559 B2 * 7/2008 Flatt ..... 2/181
7,681,252 B1 * 3/2010 Petry ..... 2/181
8,296,866 B2 * 10/2012 Kelly ..... 2/181
2003/0041365 A1 * 3/2003 Sanchez ..... 2/181.6
2004/0199979 A1 * 10/2004 Ngan ..... 2/195.1
2005/0138844 A1 * 6/2005 Johnson ..... 36/44

(Continued)

FOREIGN PATENT DOCUMENTS

JP 2002201525 A * 7/2002

OTHER PUBLICATIONS

English Machine Translation of Hirata (Japanese Patent Application Publication JP 2002-201525); 10 pages total.*

*Primary Examiner* — Andrew W Collins
(74) *Attorney, Agent, or Firm* — Fellers, Snider, Blankenship, Bailey & Tippens, P.C.

(57) ABSTRACT

A headband apparatus is to be worn on the head of a person above the eyes. The headband apparatus includes a fabric band and a channel member. The fabric band retains the headband apparatus on the user's head and may either be moisture absorbing or moisture wicking. The channel member is bonded to the lower edge of the fabric band such that excess moisture from the fabric band is directed into the channel member and channeled away from the person's eyes.

10 Claims, 2 Drawing Sheets

(56) References Cited

U.S. PATENT DOCUMENTS

2005/0223472 A1* 10/2005 Shin ..... 2/181
2006/0143788 A1* 7/2006 Presswood ..... 2/181
2007/0044204 A1* 3/2007 Kelly ..... 2/171
2007/0079423 A1* 4/2007 Flatt ..... 2/181.6
2008/0263751 A1* 10/2008 Flatt ..... 2/411
2008/0282448 A1* 11/2008 Cho ..... 2/181

* cited by examiner

HEADBAND APPARATUS FOR WICKING AND DIRECTING PERSPIRATION

CROSS REFERENCE TO RELATED APPLICATION

This application claims the benefit of U.S. Provisional Patent Application Ser. No. 60/975,113, filed on Sep. 25, 2007, the disclosure of which is incorporated herein by reference as if fully set out at this point.

BACKGROUND

1. Field of the Invention

This invention relates to head bands in general, and specifically to headbands designed to prevent perspiration from entering the eyes.

2. Description of the Related Art

It is known that work, exercise or activity in elevated temperatures produces perspiration. If the work or exercise is vigorous, or if the temperature is sufficiently high, the volume of perspiration likewise increases. One problem known to occur in such conditions is for perspiration from the head/forehead to collect and then run into the eyes. This causes discomfort (stinging) of the eyes and may affect the vision. When such a distraction takes place, work or athletic performance often suffers.

In response to this problem, headbands were developed in an effort to reduce this problem. Traditional headbands were made of elastic moisture absorbent material such as terry cloth. Such headbands are sufficient to absorb moderate amounts of perspiration. However, known problems with traditional headbands are that they become saturated and are no longer able to absorb more moisture. When this happens, perspiration once again runs into the eyes. In addition, traditional headbands are known to be hot and uncomfortable to the wearer. A need, therefore, exists for a headband apparatus which is cool and comfortable to wear and also is capable of directing perspiration away from the eyes when the fabric becomes supersaturated.

Moisture wicking fabrics have become popular with regard to the construction of athletic apparel. Such fabrics are known to wick perspiration away from the body rather than absorb it. Such materials are known to be superior to cotton and other natural fibers traditionally worn for athletic endeavors. These high performance fibers wick perspiration so that it evaporates off. This is known to provide an evaporative cooling effect on the athlete.

SUMMARY OF INVENTION

The present disclosure includes a headband apparatus intended for wear on the head of a person during exercise or strenuous activity. It is intended that the headband apparatus be worn as low on the forehead as comfortable, just above the eyes for the purpose of absorbing moisture, mostly perspiration, and directing that moisture away from the eyes of the person.

The headband apparatus includes at least two components. One of the components is a fabric band. The fabric band includes at least one of a moisture wicking segment capable of wicking moisture from at least part of the head of the person. In the alternative, the fabric band may include at least one moisture absorbing segment capable of absorbing moisture from at least part of the head of the person. In yet another aspect of the invention, the fabric band may include a moisture wicking segment and a moisture absorbing segment.

The fabric band is preferably a continuous band of stretchable material. However, the fabric band may alternatively include loose ends that are tied in a bandana fashion or it may be incorporated into a skull cap or other such configuration.

The second component is a channel member capable of collecting moisture and channeling it away from the eyes and face. The channel member is preferably constructed from a flexible but non-absorbent material such as an elastomeric material. The channel preferably includes curved edges in cross section and is open at the ends so as to retain moisture therein which is directed outwardly and deposited on the sides of the person's face. The length of the channel member is bonded to the lower edge of the fabric band so as to preferably extend the width of the person's face. In the preferred embodiment, the channel member is sewn to the lower edge of the fabric band.

In use, moisture is absorbed from the person's head by the fabric band where it is absorbed and/or evaporated. However, when/if the fabric band becomes super saturated, moisture is then directed into the channel member where it is channeled away from the person's face.

A better understanding of the present invention, its several aspects, and its advantages will become apparent to those skilled in the art from the following detailed description, wherein there is described the preferred embodiment of the invention, simply by way of illustration of the best mode contemplated for carrying out the invention.

DESCRIPTION OF THE PREFERRED EMBODIMENT

Figure 1:
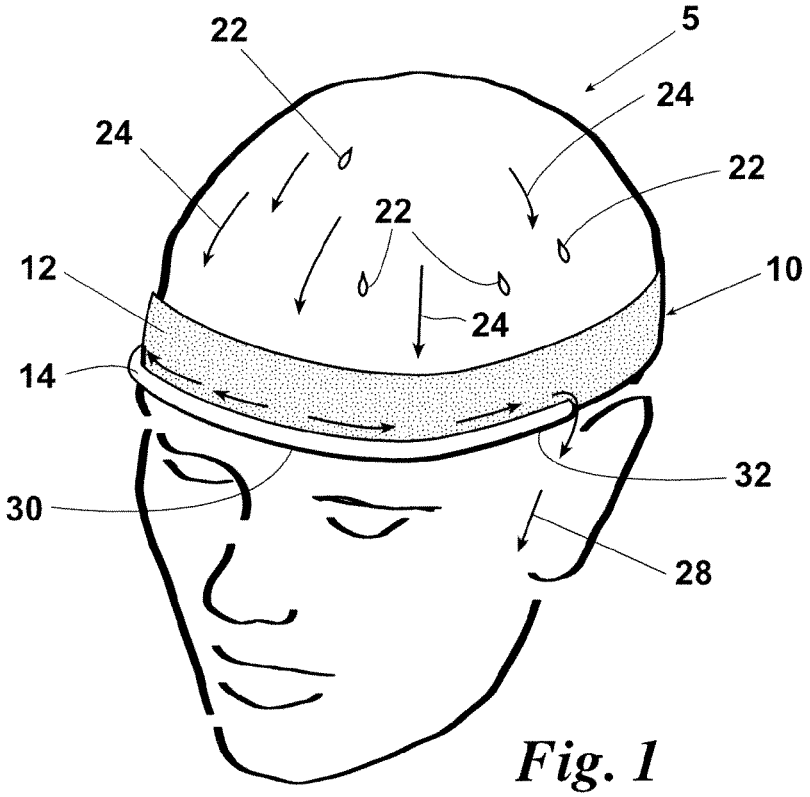
FIG. 1 is an isometric sketch of the headband apparatus of the present disclosure depicting the manner in which it wicks and directs perspiration.

FIG. 1 is an isometric sketch depicting a person's head 5 including the headband apparatus 10 of the present invention thereon. FIG. 1 generally depicts the manner in which perspiration on the person's head 5 migrates toward and is wicked by headband apparatus 10 and is directed toward the sides of the person's head and down on the side of the face. The perspiration is thus directed away from the eyes of the person which would otherwise cause discomfort and impair vision.

Figure 4:
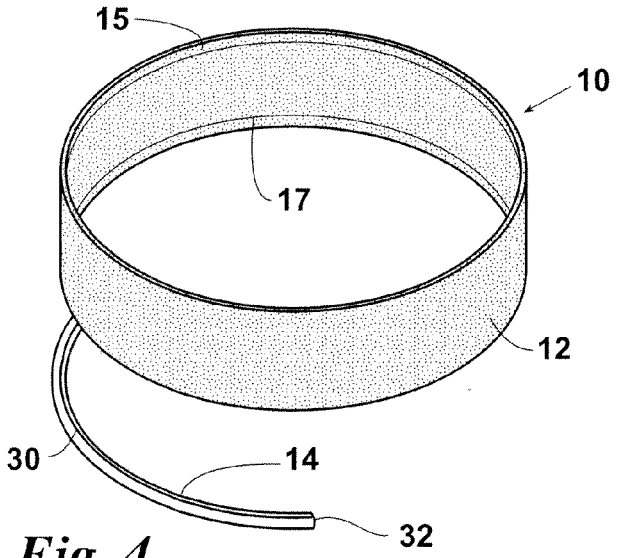
FIG. 4 is an isometric exploded view of the headband apparatus of the present disclosure.
Figure 6:
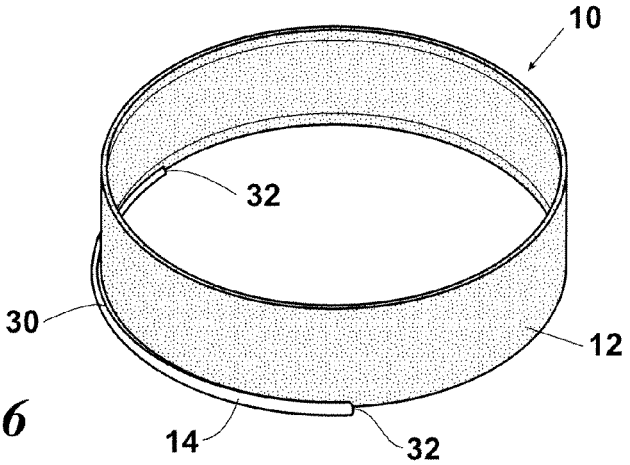
FIG. 6 is an isometric view of the headband apparatus of the present disclosure.

Referring to FIG. 4, headband apparatus 10 generally includes a moisture wicking or moisture absorbing segment, fabric band 12, and a moisture channeling segment, channel member 14. Channel member 14 is affixed to fabric band 12 in the assembled structure as shown in FIG. 6.

Fabric band 12 is generally constructed from a strip of fabric sewn together at the free ends to substantially form a circular geometry, or continuous band. The sides of fabric band 12 are preferably sewn to form hems 15 and 17 to prevent fraying and provide a more finished appearance.

In alternate embodiments, fabric band 12 may be configured so as to have free ends. In this embodiment, fabric band 12 is intended to be wrapped around the head of the wearer such that the free ends are tied at the back of the head in a tie-back arrangement in a manner similar to a traditional bandana worn around the head. In yet another embodiment, fabric band 12 may be configured to include a segment which covers the top of the head as in a traditional skull cap. The term "fabric band" is used herein to describe all such alternate embodiments, with the band depicted in the figures being the preferred embodiment. In all such alternate embodiments, channel 14 would be secured to fabric band 12.

Fabric band 12 is preferably constructed of high performance micro fiber fabric known to wick moisture. Most particularly, fabric band 12 may be constructed of a micro fiber fabric including a polyester and spandex blend. The preferred blend would include approximately 83% polyester and 17% spandex. However, it would be understood by one of skill in the art that other fabric blends known to wick away moisture from a person's skin could be substituted in the construction of fabric band 12.

In the alternative, fabric band 12 may be constructed of moisture absorbent fabric. Any known moisture absorbent fabrics including, but not limited to, cotton, wool, linen, silk, or hemp could be used. Once the fabric band 12 absorbs the maximum amount of moisture possible, moisture may then drain into channel member 14.

Figure 5:
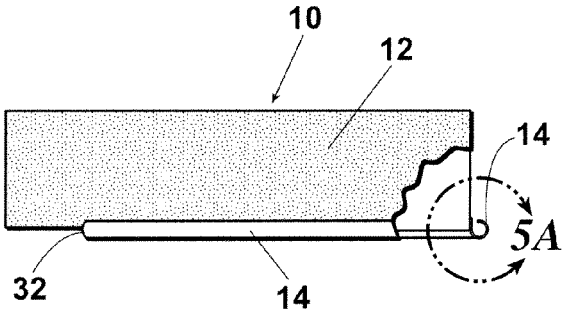
FIG. 5 is a partial cutaway side view of the headband apparatus of the present disclosure.

Again with reference to FIGS. 4-6, channel member 14 is affixed, or bonded, to the bottom edge of the fabric band 12. Channel member 14 may be bonded to fabric band 12 in any suitable manner, however, channel member 14 is most preferably sewn to the bottom edge 13 of fabric band 12.

Channel member 14 is preferably constructed of a semi-rigid elastic material which is lightweight, comfortable, to be worn against the skin, and does not absorb perspiration but rather is capable of conducting/directing perspiration along its length. Channel 14 includes a pre-curve, and preferably an R4 pre-curve which approximates the average curvature of a human forehead. Channel 14 is secured to the bottom edge of fabric band 12 such that it may be centered across the forehead of the wearer and is of a length which extends around the forehead and terminates just forward of each ear. The length of channel 14 is preferably approximately nine inches to accommodate the average forehead. However, it is understood that channel 14 could be sized larger or smaller as necessary or desired in order to accommodate larger or smaller foreheads. The correct orientation of channel 14 with respect to the wearer's head is depicted in FIG. 1 and FIG. 2.

Figure 3:
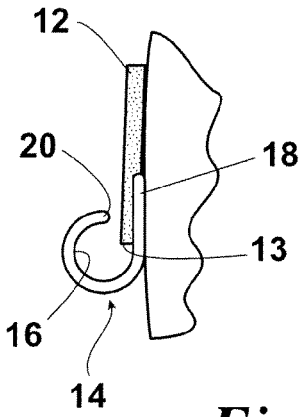
FIG. 3 depicts an enlarged cutaway side view of the headband apparatus of the present disclosure.
Figure 5A:
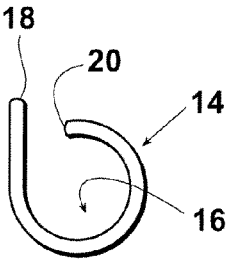
FIG. 5A depicts an enlarged detail of the headband apparatus of FIG. 5.

The geometry of channel 14 can be seen in FIGS. 3 and 5A which are enlarged views depicting channel member 14 (and fabric band 12) in cross section. As shown, the cross-sectional geometry depicts channel member 14 having substantially a closed loop including a looped portion 16 with a first end 18 which extends beyond the looped second end 20. The substantially looped portion 16 terminating at second end 20 is configured so as to retain and direct perspiration along the length of channel 14 as will be described further below. First end 18 extends from looped portion 16 to form a substantially straight segment so as to facilitate securing channel member 14 to fabric band 12 as described above.

Figure 2:
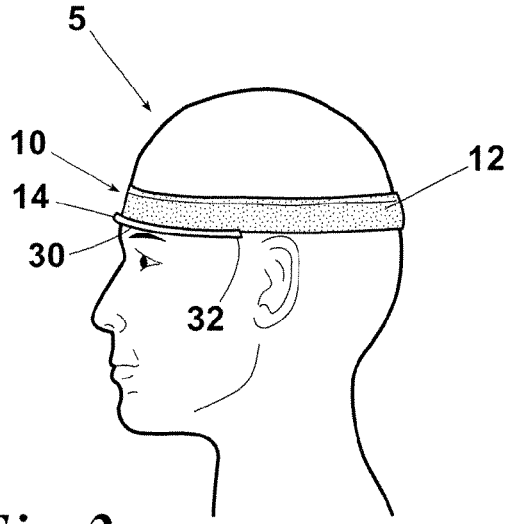
FIG. 2 is a sketch depicting the headband apparatus of the present disclosure from a side view on the head of a wearer.

With reference to FIGS. 1-3, the operation of headband apparatus 10 shall next be described. As discussed with regard to FIG. 1, beads of perspiration, generally 22 for the purpose of illustration, forming on the head of person 5 are directed by gravity generally in the direction of arrows 24 toward fabric band 12 of headband apparatus 10. Perspiration 22 is then wicked into fabric band 12. In the case of the skull cap embodiment, perspiration 22 is wicked directly into fabric band 12 covering the head of the user.

Headband apparatus 10 is positioned around the person's head on or adjacent the forehead and is retained by the elasticity of the fabric comprising fabric band 12 or drawn tight in the case of the tie-back embodiment described above. Headband apparatus 10 is positioned as low on the forehead as is comfortable for the wearer so as to allow it to wick and channel away the maximum possible perspiration from the wearer's eyes.

Once perspiration is wicked away from the wearer's skin by fabric band 12, it becomes subject to evaporation. This evaporation provides an evaporative cooling effect to the wearer of apparatus 10.

Once a point is reached where more perspiration is wicked away by fabric band 12 than can evaporate, the perspiration will begin to collect in channel 14.

With specific regard to FIG. 3, first end 18 of channel 14 extends above terminal end 20 such that a segment of fabric band 12 at its bottom edge 13 will preferably extend into looped portion 16 of channel 14. This orientation allows perspiration wicked into fabric band 12 which migrates by gravity toward bottom edge 13, to be deposited within looped portion 16 of channel 14. Looped portion 16, being a substantially closed loop terminating at second end 20, retains such perspiration within the length of channel 14.

Referring back to FIG. 1, perspiration collected along the length of channel member 14 is directed along the length of channel member 14 and directed away from the wearer's forehead and deposited on both sides of the wearer's head so as to be allowed to drain along the direction such as depicted by arrows 28 thereby avoiding the eyes of the wearer. The perspiration then runs off the face or evaporates, depending upon its volume. In this regard, the ends 32 of channel 14 are oriented so as to be slightly lower than the middle portion 30 so as to direct perspiration along the length of channel 14 to ends 32.

FIG. 1 depicts headband apparatus 10 affixed to a wearer's head such that headband apparatus 10 can be worn under an athletic helmet 40. The athletic helmet 40 could be any helmet such as a bicycle helmet, football helmet, or the like or even a motorcycle or other such helmet. Furthermore, fabric band 12 can be worn on the head of a user in sports such as soccer such that it will not interfere with the ability to perform necessary skills such as heading the ball.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A headband apparatus to be worn on the head of a person above the eyes, said apparatus comprising:

at least two components;

at least one of said at least two components being a moisture wicking segment capable of wicking moisture from at least part of the head of the person;

said moisture wicking segment being intended for contact with the head of the person;

at least one of said at least two components being a moisture channeling segment capable of receiving moisture from said at least one moisture wicking segment and channeling said moisture away from the eyes of the person;

wherein said moisture channeling segment is intended for contact with the head of the person so as to prevent moisture from passing, but is not of a length sufficient to encircle the head of the person; and wherein no portion of said moisture wicking segment is capable of contacting the head of the person between the head of the person and the moisture channeling segment.

2. The headband apparatus of claim 1 wherein said at least one moisture wicking segment is positioned on the headband apparatus so as to direct moisture into at least one of said at least one moisture channeling segments.

3. The headband apparatus of claim 1 wherein said at least one moisture wicking segment is positioned on the headband apparatus so as to direct moisture into said at least one moisture channeling segment.

4. The headband apparatus of claim 3 wherein said at least one moisture wicking segment is bonded to said at least one moisture channeling segment.

5. The headband apparatus of claim 1 wherein said at least one moisture wicking segment is fabric.

6. The headband apparatus of claim 5 wherein said at least one moisture wicking segment is a fabric band.

7. The headband apparatus of claim 6 wherein said fabric band is constructed of a microfiber fabric.

8. The headband apparatus of claim 7 wherein said microfiber fabric includes a blend of polyester and spandex.

9. The headband apparatus of claim 8 wherein said blend is approximately 83% polyester and 17% spandex.

10. The headband apparatus of claim 6 wherein said fabric is continuous.

* * * * *